US010822937B2

(12) United States Patent
Krüger

(10) Patent No.: US 10,822,937 B2
(45) Date of Patent: Nov. 3, 2020

(54) FRACTURING METHOD USING IN SITU FLUID

(71) Applicant: WELLTEC A/S, Allerød (DK)

(72) Inventor: Christian Krüger, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 16/307,554

(22) PCT Filed: Jun. 16, 2017

(86) PCT No.: PCT/EP2017/064778
§ 371 (c)(1),
(2) Date: Dec. 6, 2018

(87) PCT Pub. No.: WO2017/216347
PCT Pub. Date: Dec. 21, 2017

(65) Prior Publication Data

US 2019/0153842 A1 May 23, 2019

(30) Foreign Application Priority Data

Jun. 17, 2016 (EP) ..... 16174908

(51) Int. Cl.
*E21B 33/127* (2006.01)
*E21B 34/14* (2006.01)
(Continued)

(52) U.S. Cl.
CPC ..... *E21B 43/26* (2013.01); *E21B 33/127* (2013.01); *E21B 34/14* (2013.01); *E21B 43/14* (2013.01)

(58) Field of Classification Search
CPC ..... E21B 33/127; E21B 34/14; E21B 43/14; E21B 43/26
See application file for complete search history.

(56) References Cited

U.S. PATENT DOCUMENTS 8,408,289 B2 * 4/2013 Loree ..... C09K 8/64 166/90.1
2006/0124310 A1 * 6/2006 Lopez de Cardenas ..... E21B 34/06 166/313

(Continued)

FOREIGN PATENT DOCUMENTS

EP 2 708 694 3/2014
EP 2 728 108 5/2014

(Continued)

OTHER PUBLICATIONS

Carl Montgomery, "Fracturing Fluids", InTech, Effective and Sustainable Hydraulic Fracturing, May 17, 2013, 22 pages.

(Continued)

*Primary Examiner* — Matthew R Buck
(74) *Attorney, Agent, or Firm* — Nixon & Vanderhye P.C.

(57) ABSTRACT

The present invention relates to a fracturing method for providing fractures in a formation downhole for optimising hydro-carbon production, such as gas or shale gas production, in a well having a well tubular metal structure comprising several self-closing flow assemblies, each self-closing flow assembly comprising a sleeve which is movable along a longitudinal axis of the well tubular metal structure for opening or closing a port in the well tubular metal structure. The method comprises providing fracturing fluid derived from in situ hydro-carbons; submerging an activation device into the well tubular metal structure; pressurising the well tubular metal structure by means of the fracturing fluid derived from in situ hydro-carbons for moving the activation device towards a first self-closing flow assembly; engaging the sleeve of the first self-closing flow assembly by means of the activation device; further pressurising the well tubular metal structure by means of the fracturing fluid derived from in situ hydro-carbons for moving the sleeve of (Continued)

Figure 1:
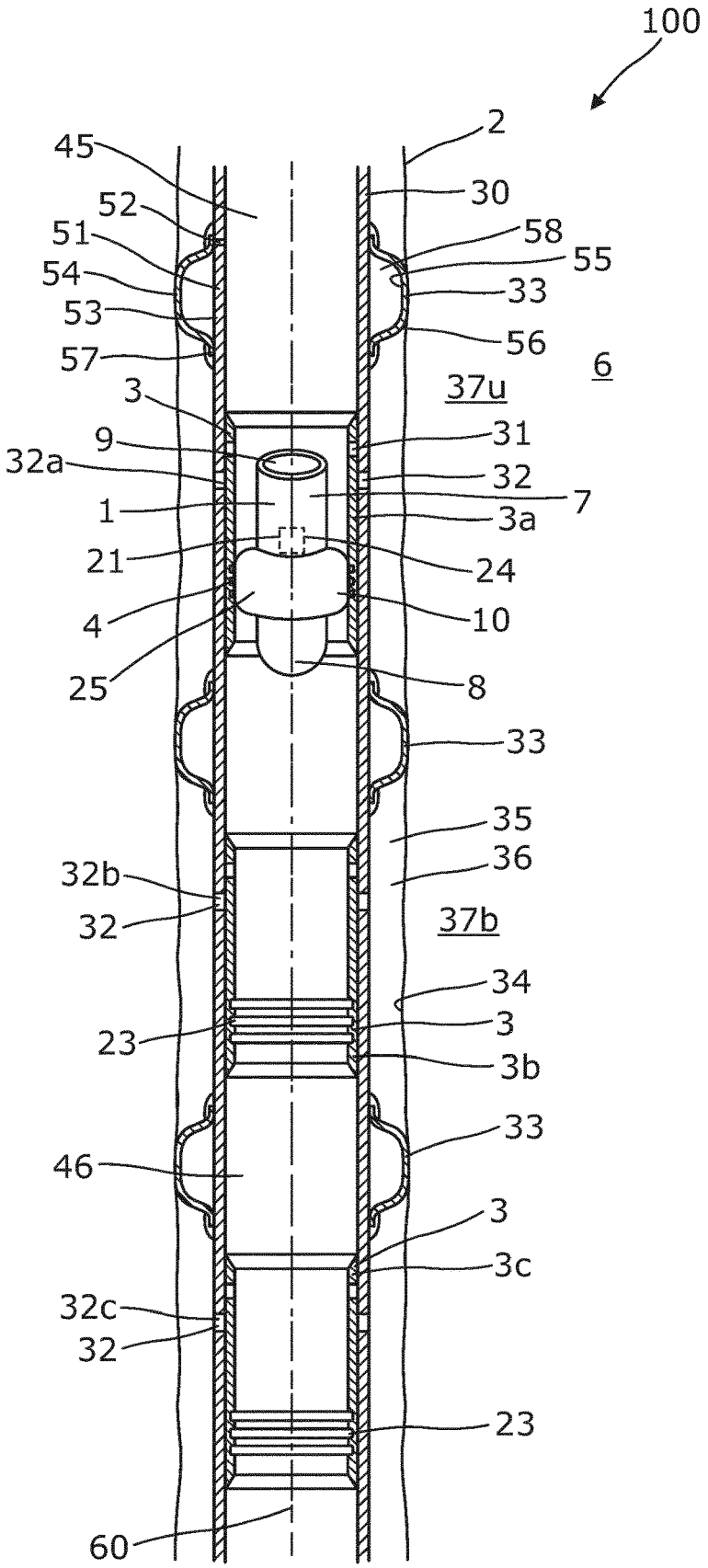

the first self-closing flow assembly and thereby opening the port; injecting the fracturing fluid derived from in situ hydr-carbons through the port of the first self-closing flow assembly for providing fractures in the formation; decreasing a pressure of the fracturing fluid by 0.5-20% for releasing the activation device from the first self-closing flow assembly, thereby closing the port; and moving the activation device by means of pressurised fracturing fluid for engaging a second self-closing flow assembly.

14 Claims, 6 Drawing Sheets

(51) Int. Cl.
*E21B 43/14* (2006.01)
*E21B 43/26* (2006.01)

(56) References Cited

U.S. PATENT DOCUMENTS

2013/0228330 A1* 9/2013 Loree ..... E21B 21/063 166/267
2014/0041876 A1 2/2014 Fleckenstein et al.
2014/0076542 A1* 3/2014 Whitsitt ..... E21B 34/14 166/250.1
2015/0204166 A1* 7/2015 Sanborn ..... E21B 21/062 166/244.1

FOREIGN PATENT DOCUMENTS

| | | |
|---|---|---|
| EP | 2 960 427 | 12/2015 |
| WO | 2011/146866 | 11/2011 |
| WO | 2015/110486 | 7/2015 |
| WO | 2015/197532 | 12/2015 |

OTHER PUBLICATIONS

Tanmay M. Soni, et al., "IADC/SPE-170542-MS LPG-Based Fracturing: An Alternative Fracturing Technique in Shale Reservoirs", IADC, SPE International, Aug. 27, 2014, 11 pages.
Eric H. Tudor, et al., "SPE 124495 100% Gelled LPG Fracturing Process: An Alternative to Conventional Water-Based Fracturing Techniques", SPE International, Sep. 25, 2009, 15 pages.
International Search Report and Written Opinion of the ISA for PCT/EP2017/064778, dated Aug. 28, 2017, 16 pages.
Extended European Search Report for EP Patent Application No. 16174908.0, dated Dec. 8, 2016, 10 pages.

* cited by examiner

FRACTURING METHOD USING IN SITU FLUID

This application is the U.S. national phase of International Application No. PCT/EP2017/064778 filed Jun. 16, 2017 which designated the U.S. and claims priority to EP 16174908.0 filed Jun. 17, 2016, the entire contents of each of which are hereby incorporated by reference.

The present invention relates to a fracturing method for providing fractures in a formation downhole for optimising hydro-carbon production, such as gas or shale gas production, in a well having a well tubular metal structure comprising several self-closing flow assemblies, each self-closing flow assembly comprising a sleeve which is movable along a longitudinal axis of the well tubular metal structure for opening or closing a port in the well tubular metal structure.

When completing a well or optimising an existing well, the formation is fractured by injecting seawater under high pressure into the formation, thereby creating fractures. However, some authorities do not allow seawater due to a conviction that the seawater will deteriorate the reservoir, especially when it comes to gas wells such as shale gas wells. Thus, fracturing is not possible in gas-producing wells, and therefore, other ways of opening the formation and creating more formation contact need to be developed.

It is an aspect of the present invention to wholly or partly overcome the above disadvantages and drawbacks of the prior art. More specifically, it is an object to provide an improved method of opening a formation and creating more formation contact in gas wells.

The above aspects, together with numerous other objects, advantages and features, which will become evident from the below description, are accomplished by a solution in accordance with the present invention by a fracturing method for providing fractures in a formation downhole for optimising hydro-carbon production, such as gas or shale gas production, in a well having a well tubular metal structure comprising several self-closing flow assemblies, each self-closing flow assembly comprising a sleeve which is movable along a longitudinal axis of the well tubular metal structure for opening or closing a port in the well tubular metal structure, the method comprising:

- providing fracturing fluid derived from in situ hydro-carbons,
- submerging an activation device into the well tubular metal structure,
- pressurising the well tubular metal structure by means of the fracturing fluid derived from in situ hydro-carbons for moving the activation device towards a first self-closing flow assembly,
- engaging the sleeve of the first self-closing flow assembly by means of the activation device,
- further pressurising the well tubular metal structure by means of the fracturing fluid derived from in situ hydro-carbons for moving the sleeve of the first self-closing flow assembly and thereby opening the port,
- injecting the fracturing fluid derived from in situ hydro-carbons through the port of the first self-closing flow assembly for providing fractures in the formation,
- decreasing a pressure of the fracturing fluid by 0.5-20% for releasing the activation device from the first self-closing flow assembly, thereby closing the port, and
- moving the activation device by means of pressurised fracturing fluid for engaging a second self-closing flow assembly.

The pressure of the fracturing fluid may be decreased by 0.5-20%, preferably 1-10% and more preferably 2-5%.

The fracturing method as described above may comprise storing a part of the fracturing fluid which is in excess during depressurising for realising the activation device for moving the activation device between two self-closing flow assemblies, and reusing the stored part of fracturing fluid during pressurising the well tubular metal structure again.

By using fracturing fluid derived by in situ hydro-carbons, the excess of fracturing fluid is allowed to be reused during the next step of pressurisation. When using water or acid as fracturing fluid, the water becomes polluted by the hydro-carbons in the well and the operator is not allowed to reuse the fracturing fluid and needs to clean the water before ejecting the fracturing fluid into the environment. When using the fluid already present in the well, the well and the surrounding formation is not "polluted"/damaged by the water or acid since the fracturing fluid is derived from the same as is already present in the formation. The fracturing fluid derived from in situ hydro-carbons does furthermore not need to be cleaned afterwards as this is in situ fluid. In certain gas reservoirs, the operators are not allowed to use water or acid as these harm the reservoir and therefore operators use gas to press onto a dropped ball seating in a valve seat.

However, when using gas, large quantities of gas leave the well when decreasing the pressure between one ball and dropping the next ball, as the pressure is released from the well during this procedure. Thus, a very large quantity of gas is used demanding a very large storage container at surface which increases the cost significantly for producing the fracturing process.

Furthermore, by using fracturing fluid derived from the in situ hydro-carbons as fracturing fluid in combination with the submergible activation device, only a small amount of gas leaves the well when the pressure is reduced to release the activation device. If gas was used as fracturing fluid without the activation device, the pressure had to be fully released for shifting the sleeves or a new ball had to be dropped to seat in a certain ball seat to shift the next sleeve.

The activation device may engage the sleeve of the self-closing flow assembly by projecting a projectable means from a body of the activation device.

The fracturing method described above may further comprise further pressurising the well tubular metal structure by means of the fracturing fluid for moving the sleeve of the second self-closing flow assembly and thereby opening a second port; injecting the fracturing fluid through the second port of the second self -closing flow assembly for providing fractures in the formation; decreasing the pressure of the fracturing fluid by 0.5-20% for releasing the activation device from the second self-closing flow assembly, thereby closing the second port; and moving the activation device by means of pressurised fracturing fluid for engaging a third self-closing flow assembly.

Furthermore, the fracturing method may comprise further pressurising the well tubular metal structure by means of the fracturing fluid for moving the sleeve of the third self-closing flow assembly and thereby opening the port; injecting the fracturing fluid through the port of the third self-closing flow assembly for providing fractures in the formation; decreasing the pressure of the fracturing fluid by 0.5-20% for releasing the activation device from the third self-closing flow assembly, thereby closing the port; moving the activation device by means of pressurised fracturing fluid for engaging a fourth self-closing flow assembly; and continuing the above steps until the intended number of fractured zones opposite the number of self-closing flow assemblies has been provided.

Moreover, the fracturing method may further comprise releasing the pressure after providing fractures in the formation through the self-closing flow assemblies; and collecting all excess fracturing fluid from the well tubular metal structure.

In addition, the fracturing method may further comprise initiating production of hydro-carbons by opening one or more self-closing flow assemblies.

Also, the fracturing fluid may be a gas, and the pressure of the pressurised fracturing fluid may be sufficient to transform the gas into liquid.

Furthermore, the fracturing fluid may be propane.

Additionally, the pressure of the fracturing fluid may be at least 40 bar.

Moreover, the hydro-carbons may be shale gas.

Additionally, the well tubular metal structure may be provided with a plurality of annular barriers, each annular barrier comprising:

- a tubular metal part for mounting as part of the well tubular metal structure, the tubular metal part having a first expansion opening and an outer face,
- an expandable metal sleeve surrounding the well tubular metal part and having an inner face facing the tubular metal part and an outer face facing a wall of a borehole of the well, each end of the expandable metal sleeve being connected with the tubular metal part, and
- an annular space between the inner face of the expandable metal sleeve and the tubular metal part, the expandable metal sleeve being configured to expand by injecting pressurised fluid into the annular space through the first expansion opening.

Furthermore, one or more of the self-closing flow assemblies may be arranged between two adjacent annular barriers.

Moreover, the activation device for being submerged into the well tubular metal structure may comprise:

- a body having a width,
- a leading end, and
- a trailing end, wherein the body further comprises an expandable sealing element arranged between the leading end and the trailing end, moving from a first position in which fluid is allowed to pass the device and a second position in which the sealing element abuts an inner face of the sleeve and seals off a first section in the well from a second section in the well.

Also, the activation device further comprises projectable keys for engaging a profile of the sleeve and opening the sleeve as the activation device is forced downwards when the sealing element abuts the inner face of the sleeve.

In addition, the activation device may further comprise a detection unit for detecting the sleeve.

Moreover, the body may comprise an activation means for activating the sealing element to move from the first position to the second position or from the second position to the first position.

Finally, the activation device may further comprise an activation sensor configured to activate the sealing element to move from the second position back to the first position when a condition in the well changes.

Figure 2:
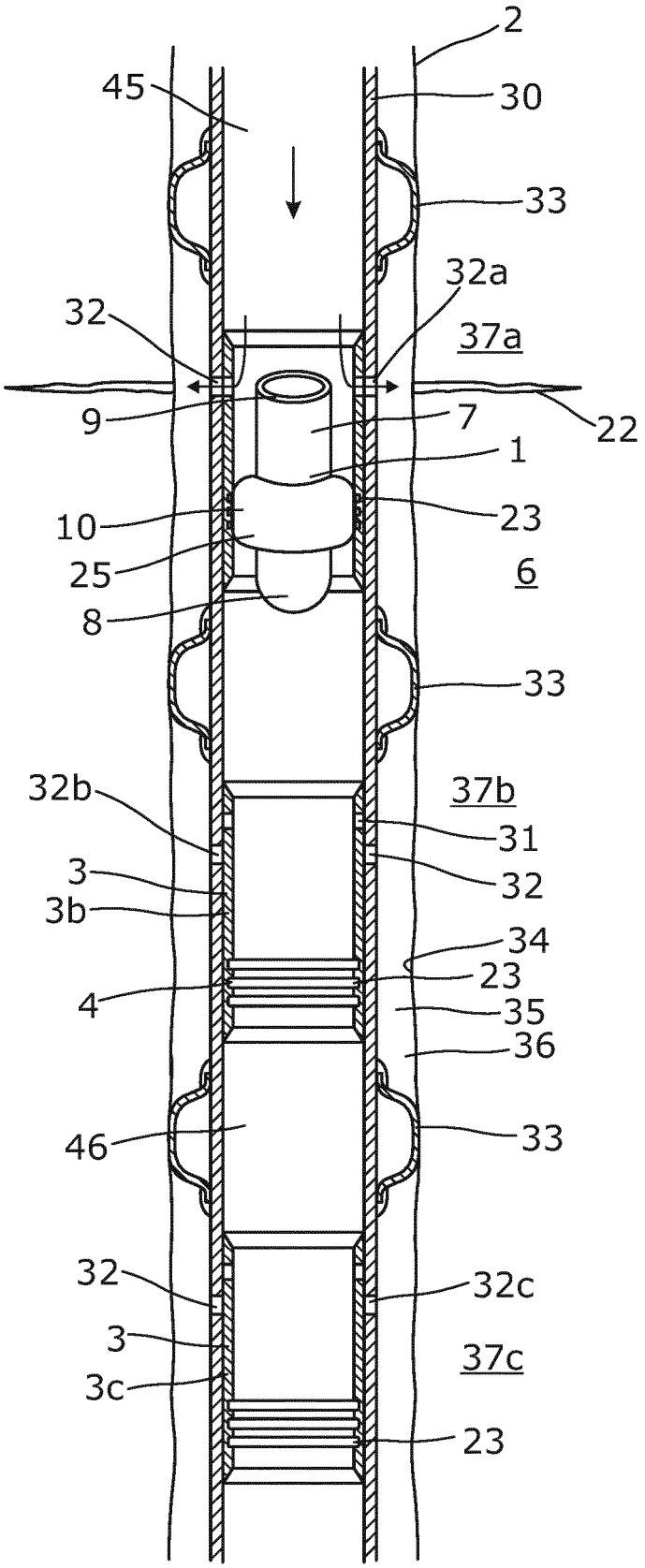
Figure 3:
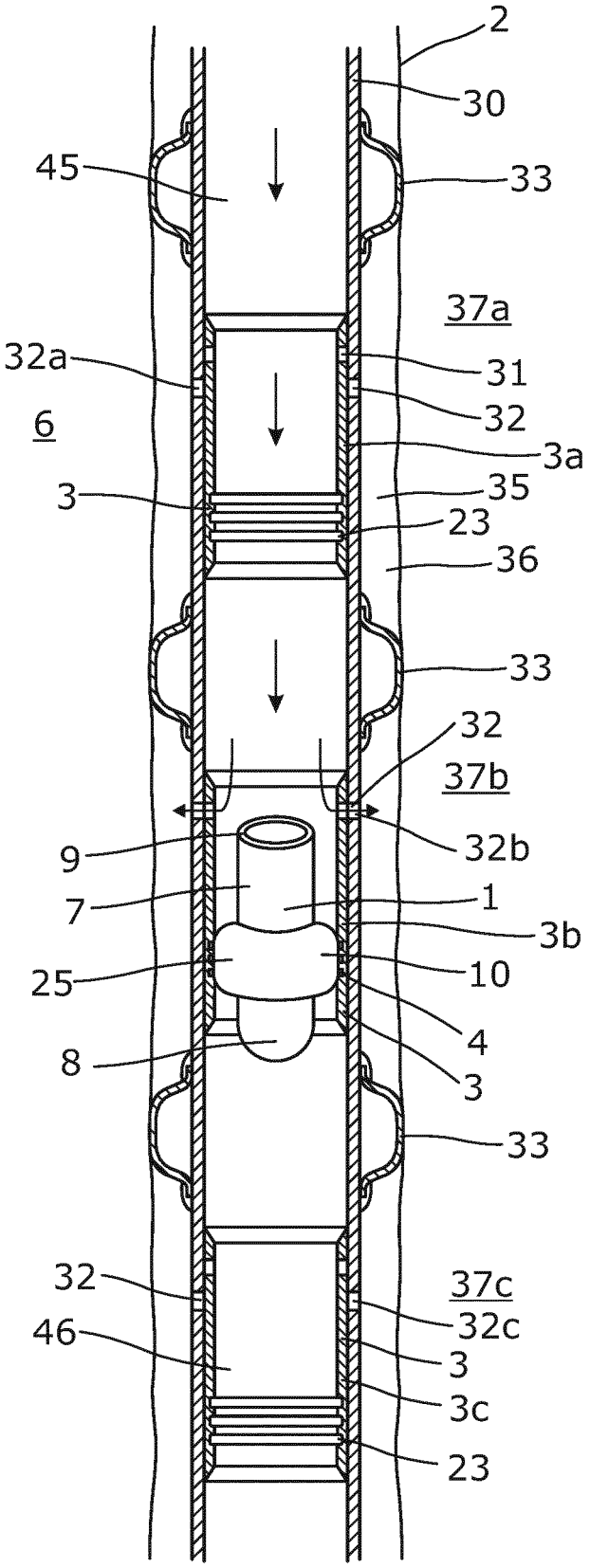

The invention and its many advantages will be described in more detail below with reference to the accompanying schematic drawings, which for the purpose of illustration show some non-limiting embodiments and in which FIG. 1 shows a partly cross-sectional view of a downhole system having an activation device engaging a sleeve, FIG. 2 shows a partly cross-sectional view of the downhole system of FIG. 1, in which the activation device has opened a first port, FIG. 3 shows a partly cross-sectional view of the downhole system of FIG. 1, in which the activation device has opened a second port.

Figure 4:
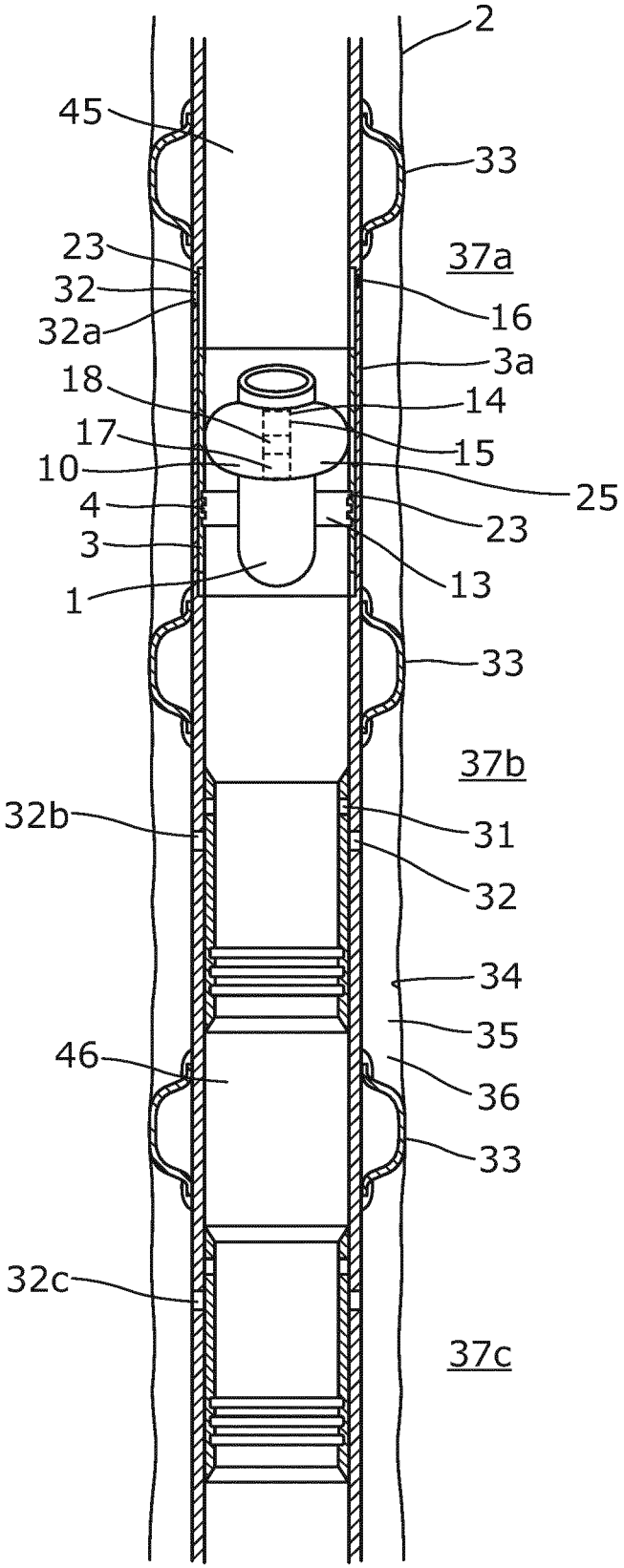
Figure 5:
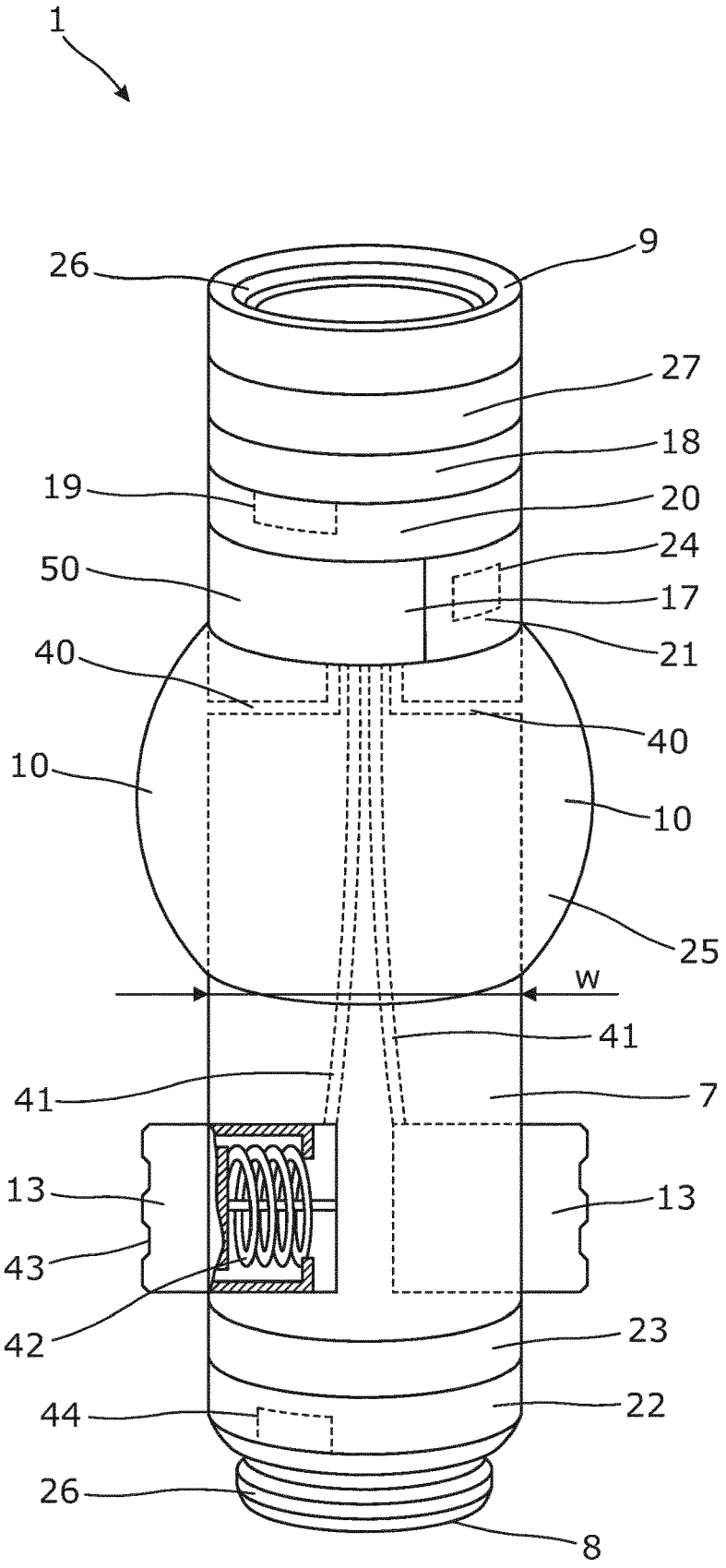
Figure 6:
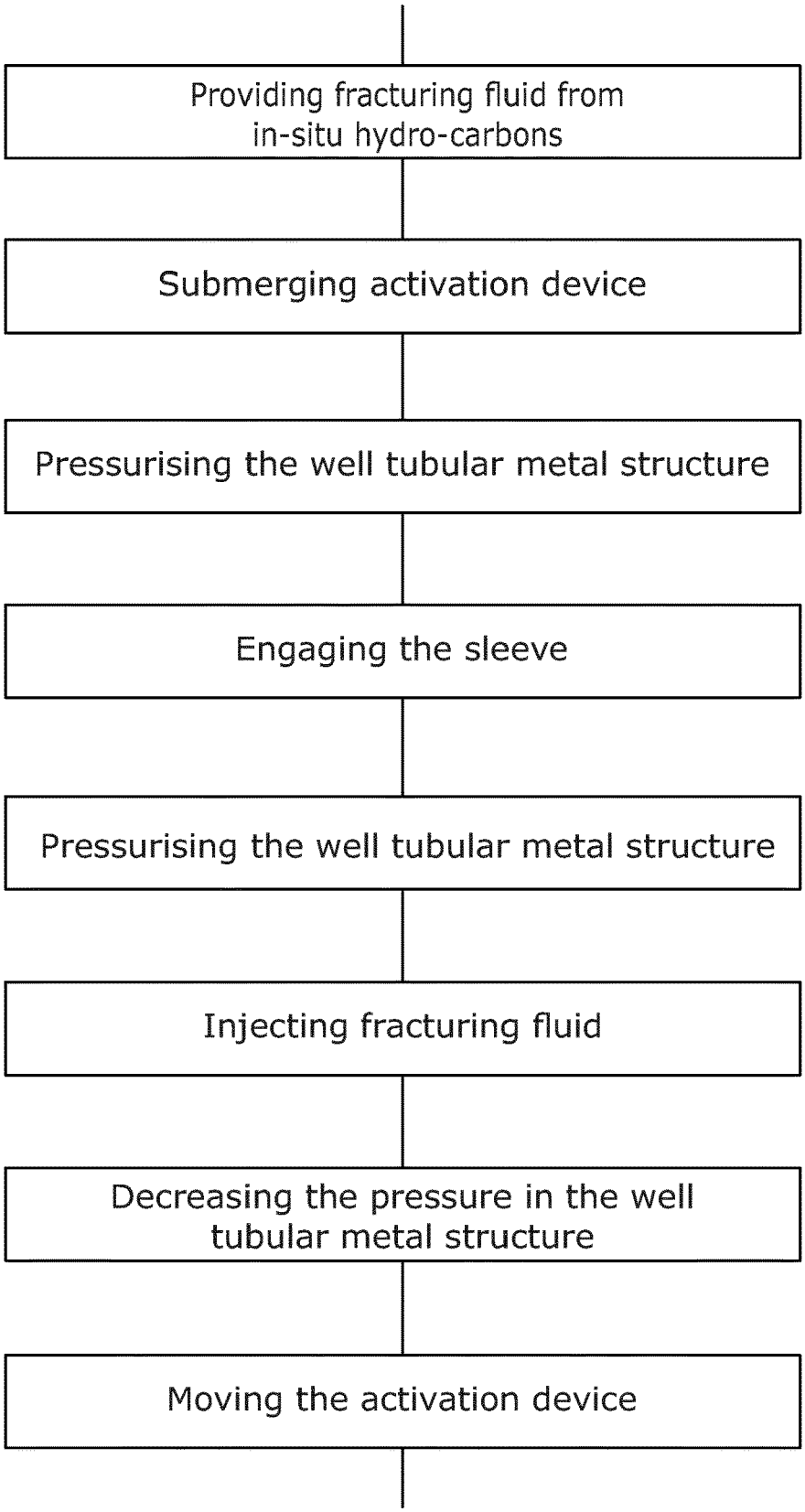

FIG. 4 shows a partly cross-sectional view of another downhole system having a monobore where the sleeve is flush with the well tubular metal structure, FIG. 5 shows a partly cross-sectional view of an activation device, and FIG. 6 shows a diagram of the fracturing method.

All the figures are highly schematic and not necessarily to scale, and they show only those parts which are necessary in order to elucidate the invention, other parts being omitted or merely suggested.

FIGS. 1-3 show a fracturing method for providing fractures in a formation 6 downhole for optimising hydro-carbon production, such as shale gas production, in a well 2 having a well tubular metal structure 30 comprising several self-closing flow assemblies 3. FIG. 1 shows a downhole system 100 where the well tubular metal structure 30 has self-closing flow assemblies 3 with sleeves 4 and where an activation device 1 has been submerged into the well tubular metal structure and the activation device 1 engages a first self-closing flow assembly 3, 3*a*. Each self-closing flow assembly 3 comprises a sleeve 4 which is movable along a longitudinal axis 60 of the well tubular metal structure 30 for opening or closing a port 32 in the well tubular metal structure 30. The fracturing process is performed by providing fracturing fluid derived from hydro-carbons, such as by transforming shale gas into propane, which fluid is liquefied under a certain pressure and is thus suitable for providing fractures in the formation 6 of a gas well 2 without using out-coming liquid but only using "in situ fluids". After providing the fracturing fluid derived from hydro-carbons, the activation device 1 is submerged into the well tubular metal structure 30, and the well tubular metal structure is pressurised by pressurising the fracturing fluid for moving the activation device 1 towards the first self-closing flow assembly 3, 3*a* comprising the sleeve 4 which is engaged by the activation device. After engaging the sleeve 4, the well tubular metal structure 30 is further pressurised by applying further fracturing fluid for moving the activation device 1 and thus the sleeve of the first self-closing flow assembly 3, 3*a* and opening the port 32. The fracturing fluid is then allowed to enter through the open port 32 by being injected through the port 32, thereby providing fractures 22 in the formation, as illustrated by arrows in FIG. 2. When the formation 6 in that zone 37*a* has been sufficiently fractured, the pressure of the fracturing fluid is decreased by 0.5-20%, preferably 1-10% and more preferably 2-5%, thereby releasing the engagement of the activation device from the first self-closing flow assembly, and the sleeve 4 closes the port 32. The smaller the decrease, the smaller amount of fracturing fluid has to leave the well and be accumulated at the top of the well. Subsequently, the inside of the well tubular metal structure is pressurised again by pressurised fracturing fluid moving the activation device for engaging a second self-closing flow assembly 3, 3*b*. The fracturing method is also shown in the diagram of FIG. 6.

When fracturing zones in a gas well producing hydro-carbons, such as shale gas, use seawater or acid as fracturing fluid, there is a risk that the fracturing fluid will harm the gas reservoir, which has caused an increasing number of oil companies and/or authorities to restrict the use of seawater or acid as fracturing fluid. However, when using in situ fluid, i.e. using a fracturing fluid which is derived from the hydro-carbons produced in the reservoir, the fracturing fluid does not comprise any fluid types which are not already present in the hydro-carbon reservoir, and the fracturing process can thus still be used. When using propane gas, the propane gas is transformed into liquid in the position opposite the zones to be fractured, and thus, the propane functions in the same way as e.g. water.

By using gas derived from the hydro-carbons as fracturing fluid in combination with the submergible activation device, only a small amount of gas leaves the well when the pressure is reduced to release the activation device. If gas was used as fracturing fluid without the activation device, the pressure had to be fully released for shifting the sleeves or a new ball had to be dropped to seat in a certain ball seat to shift the next sleeve. By using the activation device, the shifting of sleeves is done by performing only a small reduction of the pressure, and only a small reservoir at the top of the well has to be provided for accumulating the small amount of fracturing gas. The fracturing gas is then supplied to the well again during the next pressurisation operation to move the activation device. When having to release the pressure entirely to shift the sleeves, a very large reservoir has to be arranged at the top of the well, as authorities do not allow the "dirty" fracturing fluid to be let into the surrounding environment.

As shown in FIG. 1, the activation device 1 engages the sleeve 4 of the self-closing flow assembly 3 by projecting a projectable element 10, being a sealing element 25, from a body 7 of the activation device 1. In FIG. 4, the projectable element 10 comprises both the sealing element 25 and projectable keys 13 engaging a profile 23 of the sleeve 4 for opening the sleeve 4 as the activation device 1 is forced downwards.

In FIG. 3, the activation device 1 has been moved further down the well 2, and the sleeve 4 of the second self-closing flow assembly 3, 3*b* has opened a second port 32, 32*b* of the well tubular metal structure by further pressurisation using the fracturing fluid, and the fracturing fluid is injected through the second port 32*b* of the second self-closing flow assembly 3, 3*b* for providing fractures in the formation 6. After fracturing a second production zone 37*b* in the formation, the pressure of the fracturing fluid is again decreased by 0.5-20% for releasing the activation device 1 from the second self-closing flow assembly 3, 3*b*, thereby closing the second port 32, 32*b*, and by pressurising the well tubular metal structure 30 again, the activation device is moved further down the well 2 by the pressurised fracturing fluid for engaging a third self-closing flow assembly 3, 3*c*. The process of increasing and decreasing the pressure is continued for engaging and disengaging the fourth, fifth etc. sleeves for fracturing a number of zones further down the well and continuing the above steps until the intended number of fractured zones opposite the number of self-closing flow assemblies has been provided. Subsequently, production of hydro-carbons is initiated by reopening one or more self-closing flow assemblies, and production can take place through the ports or through inflow control devices arranged opposite the zones in the well tubular metal structure, which are openable, e.g. by moving the sleeve in the opposite direction.

During the fracturing process, the well tubular metal structure is pressurised to a pressure of the fracturing fluid of at least 40 bar, preferably at least 50 bar. The fracturing fluid is preferably propane gas being transformable into the liquid above 40 bar.

In FIG. 5, the activation device 1 has a width w, a leading end 8 and a trailing end 9 and comprises an activation means 17 for activating a sealing element 25 to move to a different position. The sealing element 25 may be inflatable by means of fluid being pumped into the element through fluid channels 40 by the activation means 17 in the form of a pump 50, as shown in FIG. 5. The sealing element 25 may also be an elastomeric, compressible element compressed from one side along the axial extension of the activation device 1, resulting in the sealing element bulging outwards to be pressed against an inner face of the sleeve. The axial movement used for compressing the sealing element 25 to project outwards from the body 7 of the activation device 1 is provided by a motor 20 and a piston driven by a pump 50. The pump 50 may alternatively be driven directly by the fluid in the casing. The activation means 17 or the motor 20 is powered by a battery 18, resulting in an autonomous activation device 1, or is powered through a wireline. The activation device 1 comprises a detection unit 14 for detecting the sleeve. The detection unit may comprise a tag identification means 15, as shown in FIG. 4, for detecting an identification tag 16, such as an RFID tag, arranged in connection with the sleeve 4. The identification tag 16 may also be arranged in the casing at a predetermined distance from the sleeve 4.

As shown in FIG. 4, the activation device 1 comprises projectable keys 13 for engaging the profile 23 of the sleeve 4 for opening the sleeve as the activation device 1 is forced downwards when the sealing element 25 abuts the inner face of the sleeve. Thus, the projectable keys 13 engage the profile 23 in the sleeve 4, and the sealing element 25 provides a seal dividing the well 2 into a first section 45 and a second section 46. As can be seen in FIG. 5, the projectable keys 13 having a profile 43 are projectable radially from the body 7 as hydraulically activated pistons are retractable by a spring 42. The keys 13 may also be provided on pivotably connected arms or similar key solutions.

In order to be able to retract the sealing element 25 when the fracturing process has ended, the activation device 1 comprises an activation sensor 21, shown in FIG. 5, adapted to activate the sealing element to move from the second position back to the first position when a condition in the well changes. The activation sensor 21 may comprise a pressure sensor 24 adapted to activate the sealing element to move from the second position back to the first position when a pressure in the well changes. During the fracturing job, the pressure decreases, which causes the pressure sensor to activate the sealing element to retract when the pressure decrease is measured, or when a certain pressure pattern has been detected, e.g. when the pressure decreases when a certain pressure is reached.

The well tubular metal structure comprises annular barriers 33 arranged on an outer face of the well tubular metal structure and expanded to abut a wall 34 of a borehole 35 and dividing an annulus 36 between the well tubular metal structure and the borehole into production zones 37, 37*a*, 37*b*, 37*c*. In FIG. 3, a second production zone 37*b*, i.e. a production zone further away from the top of the well than the first production zone 37*a*, is being stimulated/fractured.

Each annular barrier 33 comprises a tubular metal part 51 for mounting as part of the well tubular metal structure 30, as shown in FIG. 1. The tubular metal part 51 has a first expansion opening 52 and an outer face 53 surrounded by an expandable metal sleeve 54 having an inner face 55 facing the tubular metal part and an outer face 56 facing a wall 34 of the borehole 35 of the well 2. Each end 57 of the expandable metal sleeve 54 is connected with the tubular metal part 51, thereby defining an annular space 58 between the inner face 55 of the expandable metal sleeve and the tubular metal part. The expandable metal sleeve 54 is configured to expand by pressurised fluid being injected into the annular space 58 through the first expansion opening 52. The expansion opening 52 may be connected to an expansion unit through which the fluid enters and closes the fluid communication after expansion and subsequently provides fluid communication between the annulus 36 and the space 58 for equalising the pressure between the annulus and the space.

By well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the well tubular metal structure, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A fracturing method for providing fractures in a formation downhole for optimising hydro-carbon production of a gas in a well having a well tubular metal structure comprising several self-closing flow assemblies, each self-closing flow assembly comprising a sleeve which is movable along a longitudinal axis of the well tubular metal structure for opening or closing a port in the well tubular metal structure, the method comprising:

providing fracturing fluid derived from in situ hydro-carbons already present in and produced from the reservoir, submerging an activation device having a sleeve engagement portion into the well tubular metal structure, pressurising the well tubular metal structure by means of the fracturing fluid derived from in situ hydro-carbons for moving the activation device towards a first self-closing flow assembly, engaging the sleeve of the first self-closing flow assembly by means of the sleeve engagement portion of the activation device, further pressurising the well tubular metal structure by means of the fracturing fluid derived from in situ hydro-carbons for moving the sleeve of the first self-closing flow assembly and thereby opening the port, injecting the fracturing fluid derived from in situ hydro-carbons through the port of the first self-closing flow assembly for providing fractures in the formation, decreasing a pressure of the fracturing fluid by 0.5-20% for releasing the activation device from the first self-closing flow assembly, thereby closing the port and reducing the amount of fracturing fluid that leaves the well when the pressure is released, and moving the activation device by means of pressurised fracturing fluid for engaging a second self-closing flow assembly, and wherein the fracturing fluid does not include any fluids that are not already present in the reservoir.

2. The fracturing method according to claim 1, comprising:

storing a part of the fracturing fluid which is in excess during depressurising for releasing the activation device for moving the activation device between two self-closing flow assemblies, and reusing the stored part of fracturing fluid during pressurising the well tubular metal structure again.

3. The fracturing method according to claim 1, wherein the activation device engages the sleeve of the self-closing flow assembly by projecting a projection of the sleeve engagement portion.

4. The fracturing method according to claim 1, comprising:

further pressurising the well tubular metal structure by means of the fracturing fluid for moving the sleeve of the second self-closing flow assembly and thereby opening a second port, injecting the fracturing fluid through the second port of the second self-closing flow assembly for providing fractures in the formation, decreasing the pressure of the fracturing fluid by 0.5-20% for releasing the activation device from the second self-closing flow assembly, thereby closing the second port, and moving the activation device by means of pressurised fracturing fluid for engaging a third self-closing flow assembly.

5. The fracturing method according to claim 4, comprising:

further pressurising the well tubular metal structure by means of the fracturing fluid for moving the sleeve of the third self-closing flow assembly and thereby opening a third port, injecting the fracturing fluid through the third port of the third self-closing flow assembly for providing fractures in the formation, decreasing the pressure of the fracturing fluid by 0.5-20% for releasing the activation device from the third self-closing flow assembly, thereby closing the third port, moving the activation device by means of pressurised fracturing fluid for engaging a fourth self-closing flow assembly, and continuing the above steps until the intended number of fractured zones opposite the number of self-closing flow assemblies has been provided.

6. The fracturing method according to claim 1, further comprising:

releasing the pressure after providing fractures in the formation through the self-closing flow assemblies, and collecting all excess fracturing fluid from the well tubular metal structure.

7. The fracturing method according to claim 1, further comprising initiating production of hydro-carbons by opening one or more self-closing flow assemblies.

8. The fracturing method according to claim 1, wherein the fracturing fluid is an in-situ gas already present in the formation and the pressure of the pressurised fracturing fluid is sufficient to transform the gas into liquid.

9. The fracturing method according to claim 1, wherein the fracturing fluid is in-situ propane already present in the formation.

10. The fracturing method according to claim 8, wherein the pressure of the fracturing fluid is at least 40 bar.

11. The fracturing method according to claim 1, wherein the well tubular metal structure is provided with a plurality of annular barriers, each annular barrier comprising:

a tubular metal part for mounting as part of the well tubular metal structure, the tubular metal part having a first expansion opening and an outer face, an expandable metal sleeve surrounding the well tubular metal part and having an inner face facing the tubular metal part and an outer face facing a wall of a borehole of the well, each end of the expandable metal sleeve being connected with the tubular metal part, and an annular space between the inner face of the expandable metal sleeve and the tubular metal part, the expandable metal sleeve being configured to expand by injecting pressurised fluid into the annular space through the first expansion opening.

12. The fracturing method according to claim 11, wherein one or more of the self-closing flow assemblies is/are arranged between two adjacent annular barriers.

13. The fracturing method according to claim 1, wherein the activation device for being submerged into the well tubular metal structure comprises:

a body having a width (w), a leading end, and a trailing end, wherein the body further comprises an expandable sealing element of the sleeve engagement portion arranged between the leading end and the trailing end, moving from a first position in which fluid is allowed to pass the device and a second position in which the sealing element abuts the inner face of the sleeve and seals off a first section in the well from a second section in the well.

14. The fracturing method according to claim 1, wherein pressurizing the well does not involve seawater or acid.

* * * * *